US005503383A

United States Patent [19]

Takemoto et al.

[11] Patent Number: 5,503,383

[45] Date of Patent: Apr. 2, 1996

[54] GROUND MECHANISM FOR A PAPER STRIP CONVEYING MECHANISM

[75] Inventors: Takatoshi Takemoto; Koichi Tsubota, both of Tokyo; Hideyuki Kadomatsu, Odawara; Etsurou Sasaki, Kawasaki, all of Japan

[73] Assignee: Kabushiki Kaisha Ace Denken, Japan

[21] Appl. No.: 266,051

[22] Filed: Jun. 27, 1994

[51] Int. Cl.[6] ..... B65H 5/26

[52] U.S. Cl. ..... 271/9.13; 271/272; 271/275

[58] Field of Search ..... 271/264, 272–274, 271/275, 198, 9, 9.13

[56] References Cited

U.S. PATENT DOCUMENTS 4,568,074 2/1986 Murayoshi ..... 271/119

FOREIGN PATENT DOCUMENTS 0212643 9/1988 Japan ..... 271/272

1-294136 11/1989 Japan .

0169431 6/1990 Japan ..... 271/9

5032343 2/1993 Japan ..... 271/272

5132777 5/1993 Japan ..... 271/272

2235676 3/1991 United Kingdom ..... 271/272

*Primary Examiner*—H. Grant Skaggs

*Attorney, Agent, or Firm*—Andrus, Sceales, Starke & Sawall

[57] ABSTRACT

A paper strip conveying apparatus provided along an objective conveying path, comprising an endless belt having its periphery in contact with one of the two faces of the paper strip and a plurality of pulleys provided along the conveying path so that their peripheries come in contact with the other face of the paper strip, between which a paper strip is pinched and conveyed. The object of the present invention is to shorten the length of the electric wire through which static electricity charged in a pulley flows out. In the present invention, both a pulley fixing board which supports the pulleys and a main body frame formed along the conveying path are formed of conductive material, and are electrically connected by a conductor.

4 Claims, 10 Drawing Sheets

GROUND MECHANISM FOR A PAPER STRIP CONVEYING MECHANISM

FIELD OF THE INVENTION

The present invention relates to a ground mechanism in a paper strip conveying apparatus which conveys bank notes etc.

DESCRIPTION OF THE RELATED ART

An example of a conventional ground mechanism of a paper strip conveying apparatus is disclosed in Japanese Patent Application Publication (KOKAI) No. 1-294136.

The disclosed paper strip conveying apparatus conveys paper strips by pinching the same between a number of mini pulleys and the endless belt wherein the pulleys are urged toward the endless belt. Supporting metallic parts of the rotating shaft of each mini pulley are formed of conductive material. Each of the supporting metallic parts are connected to each other by electric wires. One metallic part among the plurality of supporting metallic parts is electrically connected to earth.

However, since the supporting metallic parts of each rotating shaft are connected to each other by the electric wire for grounding in the ground mechanism of the conventional paper strip conveying apparatus, the length of the electric wire for grounding becomes longer as the conveying distance of the paper strips becomes longer, giving the problem of complicating the connecting operation.

SUMMARY OF THE INVENTION

It is therefore an object of the present invention to provide a paper strip conveying apparatus which enables shortening of the electric wire for grounding, so that the connecting operation of the electric wire becomes simple.

According to the present invention, there is provided a paper strip conveying apparatus which conveys a paper strip along an object conveying path comprising: a conveying path member which forms the conveying path where the paper strip passes through; an endless belt provided along the conveying path and having its periphery in contact with one of the two faces of the paper strip; a belt driving mechanism which rotates the endless belt; a plurality of pulleys provided along the conveying path so that their peripheries come in contact with the other face of the paper strip; rotating axes of the pulleys formed of conductive material; supporting metallic parts which support the rotating axes, formed of conductive material; a main body frame electrically connected to ground and formed of conductive material, which supports the conveying path forming member by being formed to extend along the conveying path; and a conductor which electrically connects the main body frame and each of the supporting metallic parts, respectively.

When the paper strip is conveyed between the endless belt and the pulleys, the pulleys will be charged with static electricity due to friction between the paper strip and the pulleys, causing paper strips to stick to the pulleys. This increases the possibility of trouble happening in conveyance. Therefore, in the present invention, the shafts of the pulleys, the pulley supporting metallic parts supporting these shafts, and the main body frame are formed of conductive material, and the electrical static charge stored in the pulleys is released to ground via the supporting metallic parts, the electric conductor or wire, and the main body frame by electrically connecting the pulley supporting metallic parts and the main body frame by the electric wire. In the present invention, since each of the pulley supporting metallic parts provided along the conveying path is not directly connected to each other by the electric wire but is connected to the main body frame extending along the conveying path, the length of the electric wire does not have to be long.

PREFERRED EMBODIMENTS OF THE INVENTION

Figure 2:
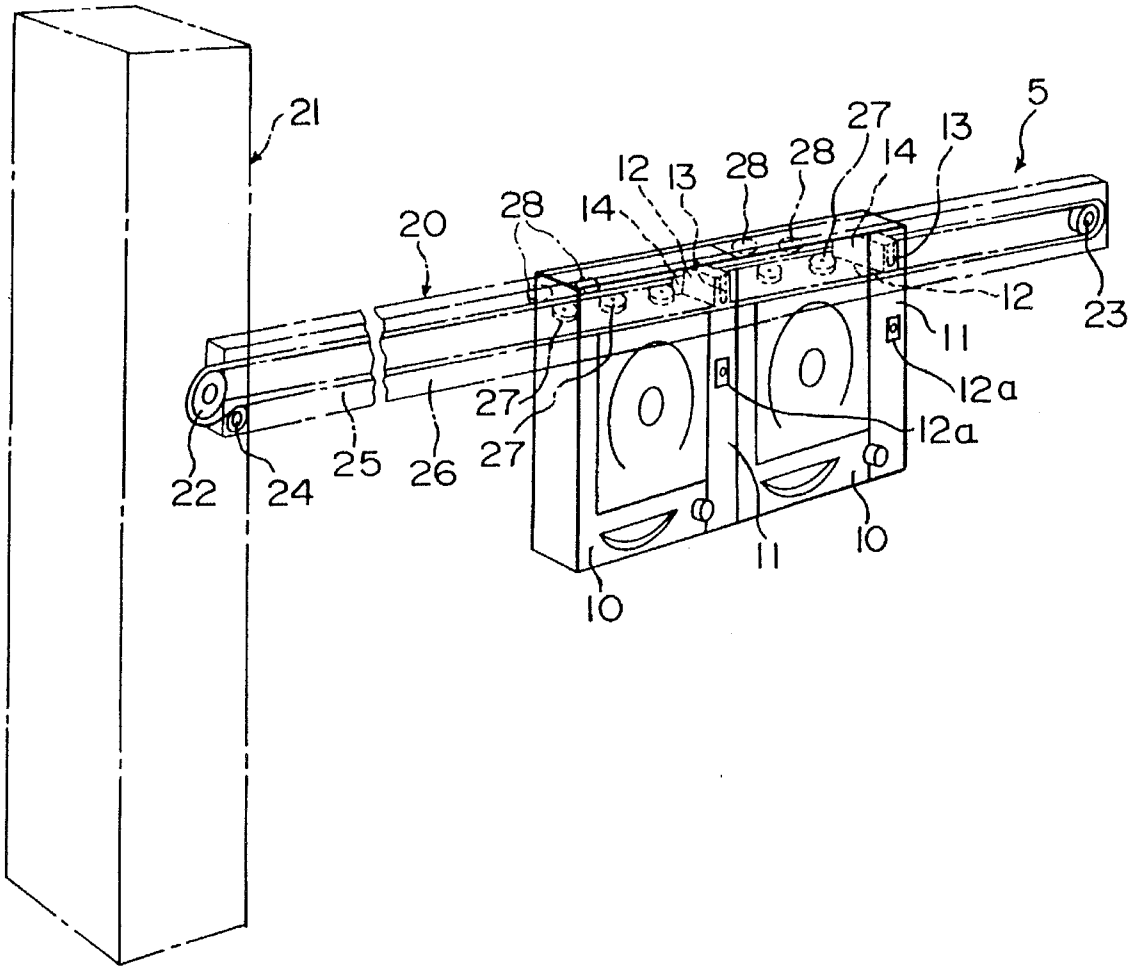
FIG. 2 is a perspective view of the pachinko island provided with the conveying device in the embodiment of the present invention.
Figure 3:
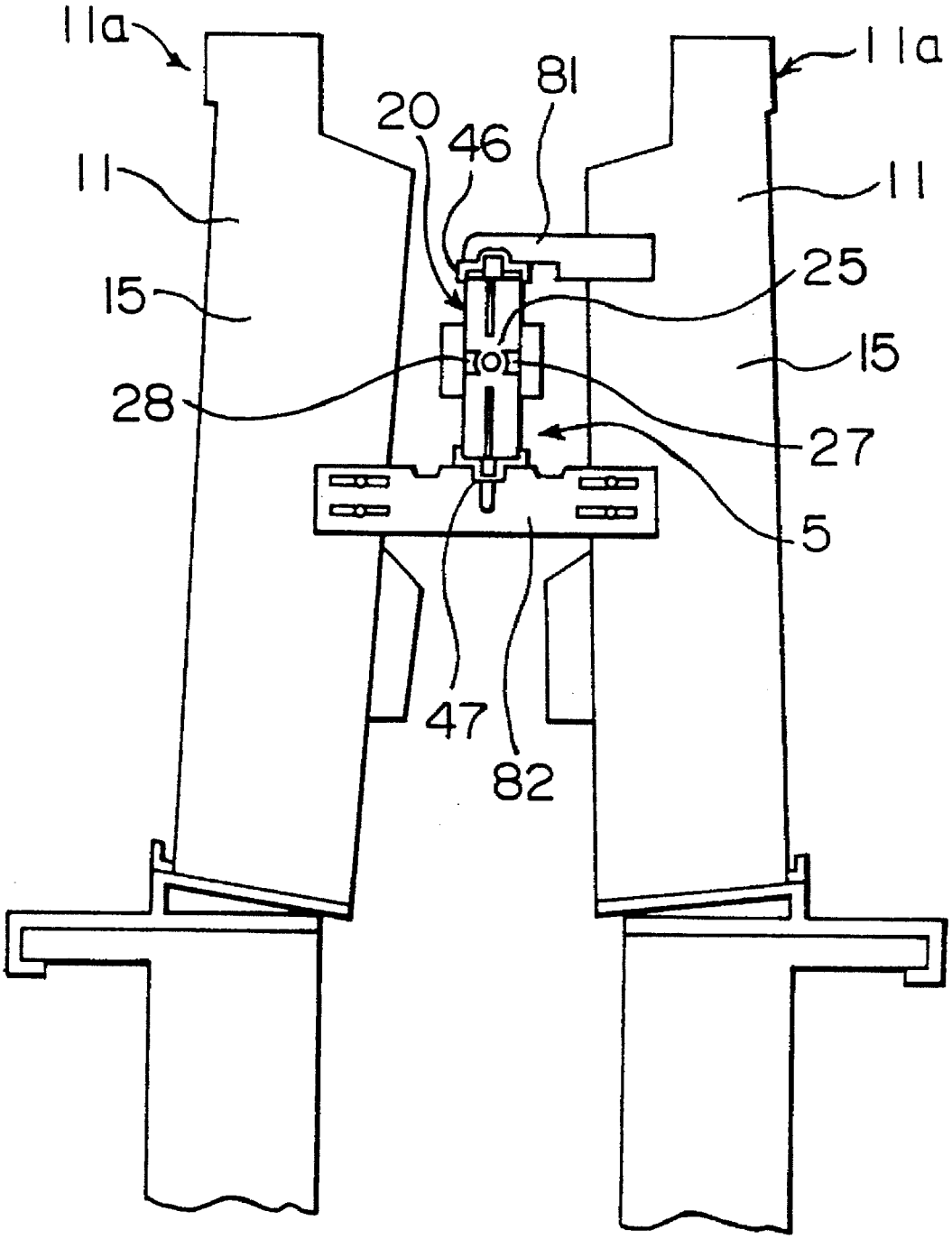
FIG. 3 is a side view of the main portion of the pachinko island provided with the conveying device in the embodiment of the present invention.

As shown in FIG. 2, a pachinko island comprises a plurality of pachinko machines 10, 10, . . . at which players enjoy games using pachinko balls, a plurality of ball lending machines 11, 11, . . . which accept a bank note and dispense a certain number of balls based on the value of the accepted bank note, a charge storing box 21 for storing the bank notes inserted into the plurality of ball lending machines 11, 11, . . . and a conveying apparatus 5 for conveying the bank notes inserted into the plurality of ball lending machines 11, 11, . . . to the charge storing box 21. The plurality of pachinko machines 10, 10, . . . and the plurality of ball lending machines 11, 11, . . . , respectively, are arranged alternately in a straight line to form a row of pachinko machines 11*a*. In the pachinko island, as shown in FIG. 3, two rows of pachinko machines 11*a*, 11*a* are arranged back to back with each other in parallel having a certain space therebetween. The conveying machine 5 is provided between the backs of the two rows of pachinko machines 11*a*, 11*a*, along the row of pachinko machines 11*a*. The charge storing box 21 is provided on one end of the two rows of pachinko machines 11*a*, 11*a*.

The ball lending machine 11 has a bank note examining unit 12 for judging whether the bank note is appropriate or not and for determining the value of the bank note, and a ball dispensing unit 12*a* for dispensing a certain number of balls based on the value of the bank note determined by the bank note examining unit 12. In the bank note examining unit 12, a bank note inserting slot 13 is formed at a position corresponding to the front of the ball lending machine 11 and a bank note discharging slot 14 is formed at a position corresponding to the back of the ball lending machine 11.

The conveying apparatus 5 includes a charge collecting line 20 which is formed straightly along the back of the row of pachinko machines 11*a*. At both ends of the charge collecting line 20, a drive pulley 22 and a driven pulley 23 are provided. An endless round belt 25 is tensioned between the drive pulley and the driven pulley. A pair of biasing pulleys 27, 28 which sandwich the round belt 25 from both sides are provided in a section between the drive pulley 22 and the driven pulley 23 where the round belt 25 is tensioned. A tension pulley 24 which adjusts the tensile force of the round belt 25 is provided on one end of the drive pulley 22 side.

Figure 1:
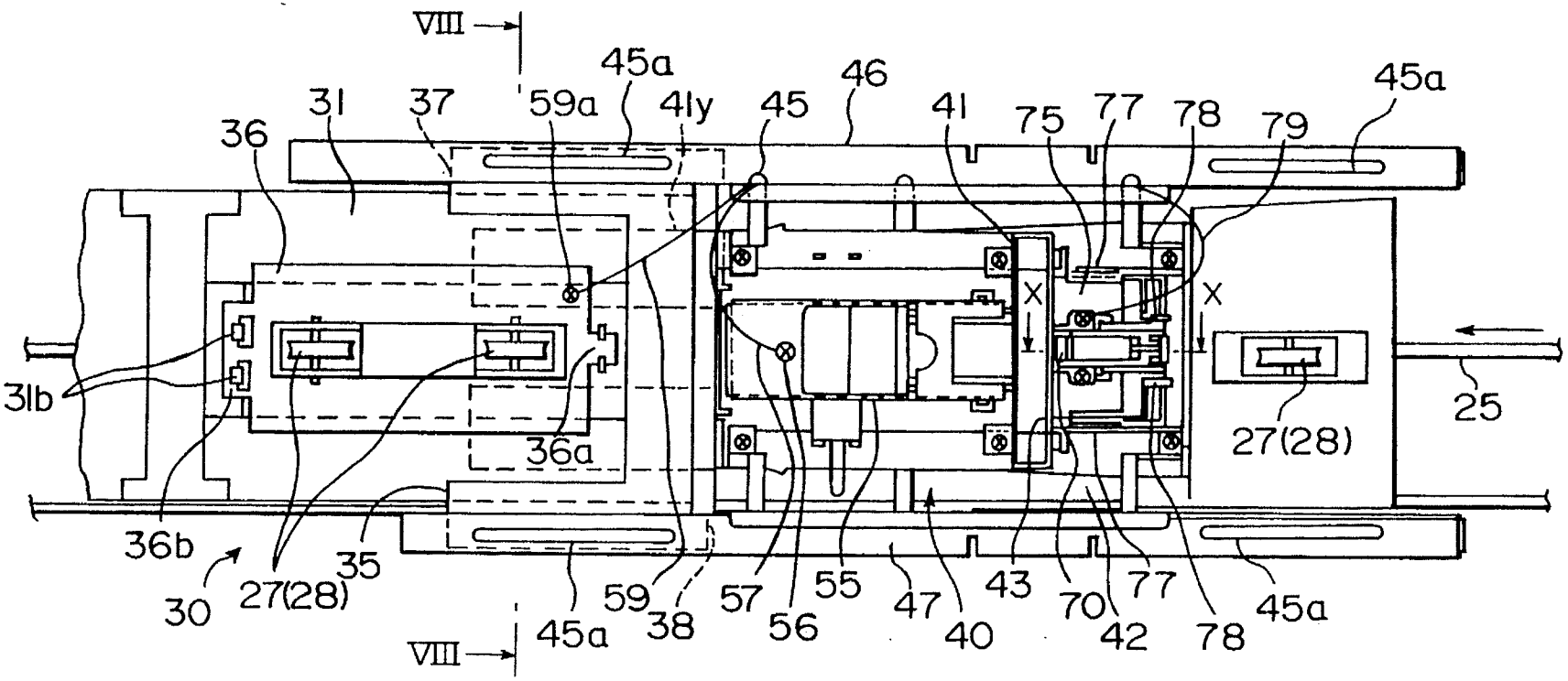
FIG. 1 is a front view of the main portion of the paper strip conveying mechanism in an embodiment of the present invention.

As shown in FIG. 1, a plurality of conveying units 30, 30, . . . which form the charge collecting line 20, and convey the bank notes to the charge storing box 21 and a plurality of introducing units 40, 40, . . . which introduce the bank notes from the ball lending machines 11, 11, . . . are continuously provided so as to form the conveying apparatus 5.

The conveying unit 30 and the introducing unit 40 are, as shown in FIG. 3, supported from the top and the bottom by connecting guide members 46, 47 which form a main body frame. The connecting guide members 46, 47 are formed of conductive material.

The connecting guide members 46, 47 on the top and bottom of the conveying apparatus 5 are supported on a side wall board 15 of the ball lending machine 11 via fixing metallic parts 81, 82. The fixing metallic parts 81, 82 and the side wall board 15 are formed of conductive material.

Figure 10:
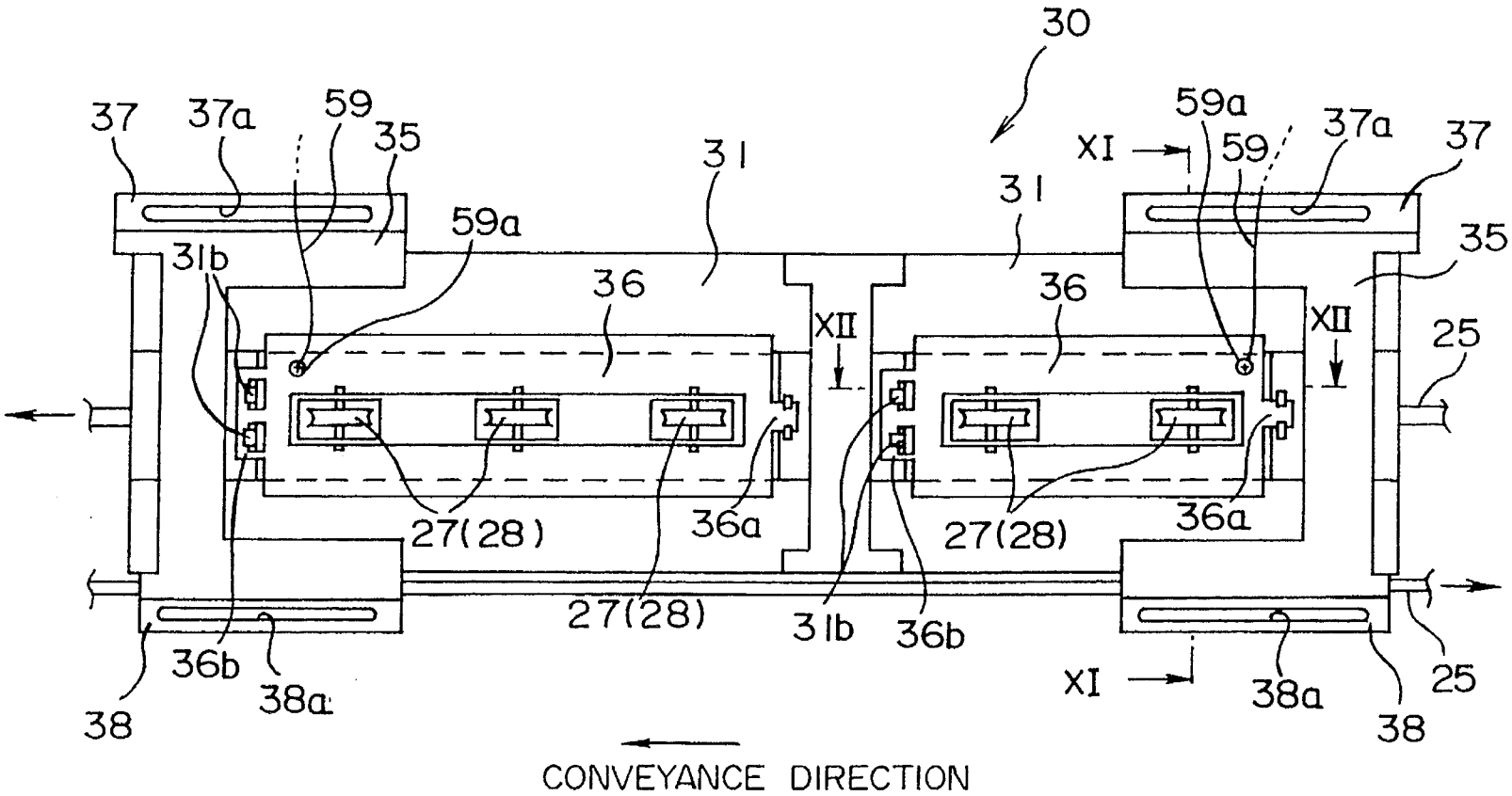
FIG. 10 is a front view of the unit at the conveying section in the embodiment of the present invention.
Figure 11:
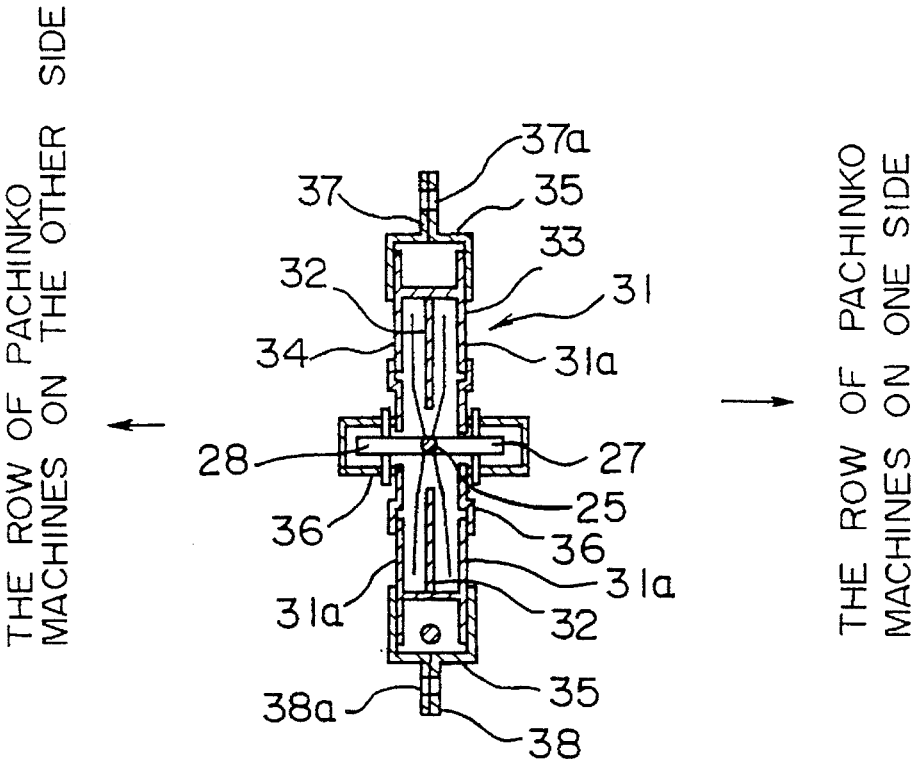
FIG. 11 is a cross sectional view taken along a line XI—XI of FIG. 10.

The conveying unit 30 comprises, as shown in FIGS. 10 and 11, a conveying path member 31 which forms the charge collecting line 21 surrounding the bank note to be conveyed, joint members 35, 35*a* provided on both ends of the conveying path member in the direction of conveyance and the above-described biasing pulleys 27, 28.

Figure 12:
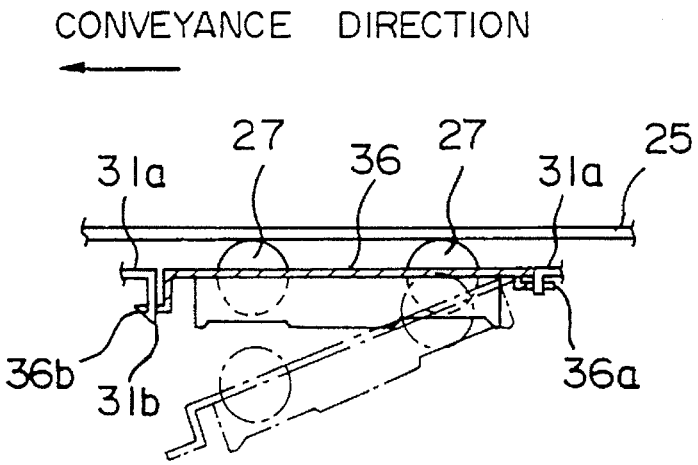
FIG. 12 is a cross sectional view taken along a line XII—XII of FIG. 10.

The conveying path member 31 includes, as shown in FIG. 11, having the round belt 25 as the center, a first conveying path forming portion 33 which forms a conveying path for the row of pachinko machines on one side, a second conveying path forming portion 34 which forms a conveying path for the row of pachinko machines on the other side, and a partition 32 which partitions the first conveying path forming portion 33 and the second conveying path forming portion 34. The above-described biasing pulleys 27, 28 are respectively provided on the row of pachinko machines on one side and the row of pachinko machines on the other side, having the round belt 25 therebetween so as to be in contact with the round belt 25. The biasing pulleys 27, 28 are covered by pulley fixing boards 36, 36 through which their axes are fixed. Each of the biasing pulleys 27, 28, their axes, and the pulley fixing boards 36, 36 are formed of conductive material. To the pulley fixing board 26, as shown in FIG. 1, one end of the electric wire 59 is connected by a ground fixing screw 59*a*. The other end of the electric wire 59 is connected to the upper connecting guide member 46 by a screw 45. Each of the conveying path forming portions 33, 34 of the conveying path member 31 has side walls 31*a*, 31*a* having an opening formed thereon. The pulley fixing board 36 is fixed on the side wall 31*a* so as to block the opening of the side wall 31*a*. As shown in FIG. 12, one end 36*a* of the pulley fixing board 36, in a direction of conveyance of bank notes, is attached to a board fixing portion formed on one side of an edge of the opening of the side wall 31*a* so as to be able to swing. On the other end of the pulley fixing board 36 in a direction of conveyance of bank notes, an engaging portion 36*b* which is detachable from a hook 31*b* formed on the other side of the edge of the opening of the side wall 31*a* is formed.

The joint member 35 has connecting rails 37, 38 extending toward the conveyance direction of bank notes on upper and lower parts of both ends of the conveying path member 31 in the conveyance direction. Elongated holes 37*a*, 38*a* elongated in the conveyance direction of bank notes, which pass through from the row of pachinko machines on one side to the row of pachinko machines on the other side, are formed on the connecting rails 37, 38.

Figure 4:
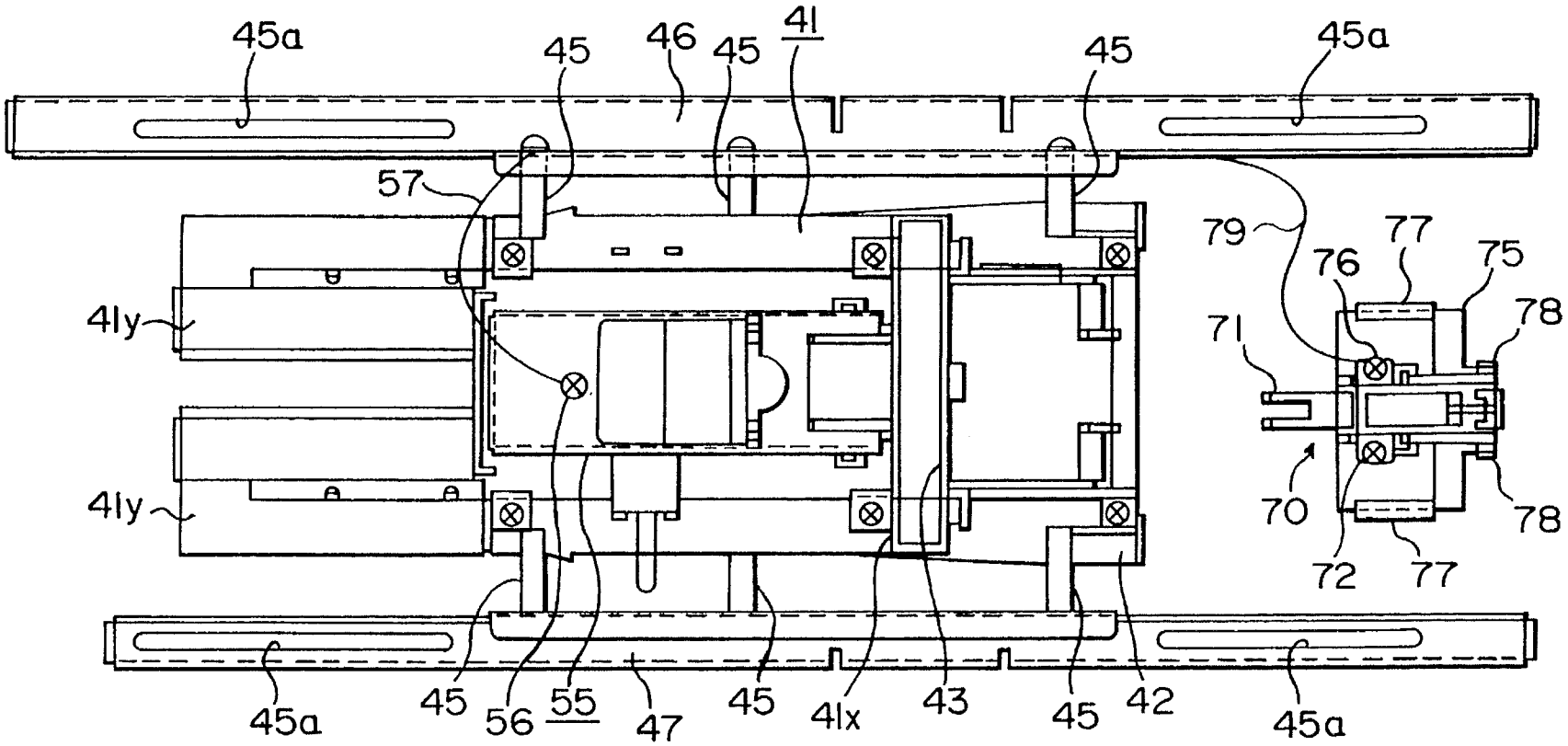
FIG. 4 is a front view of the unit at the introducing section in the embodiment of the present invention.
Figure 8:
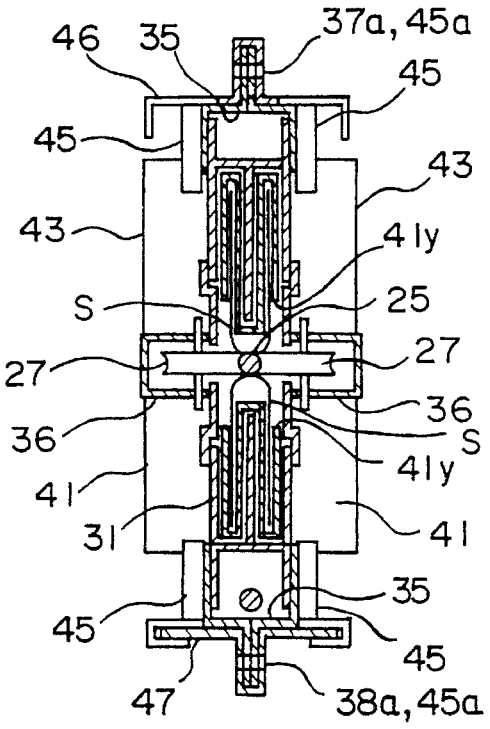
FIG. 8 is a cross sectional view taken along a line VIII—VIII of FIG. 1.
Figure 9:
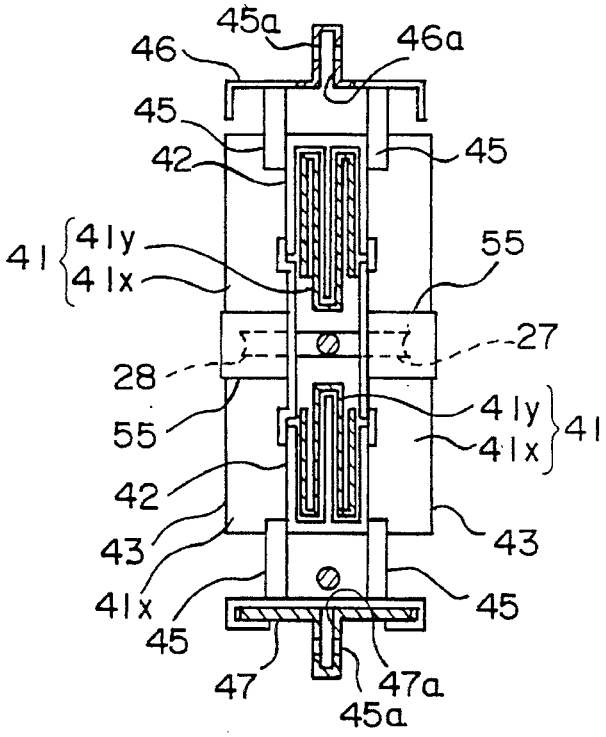
FIG. 9 is a cross sectional view taken along a line IX—IX of FIG. 13.
Figure 13:
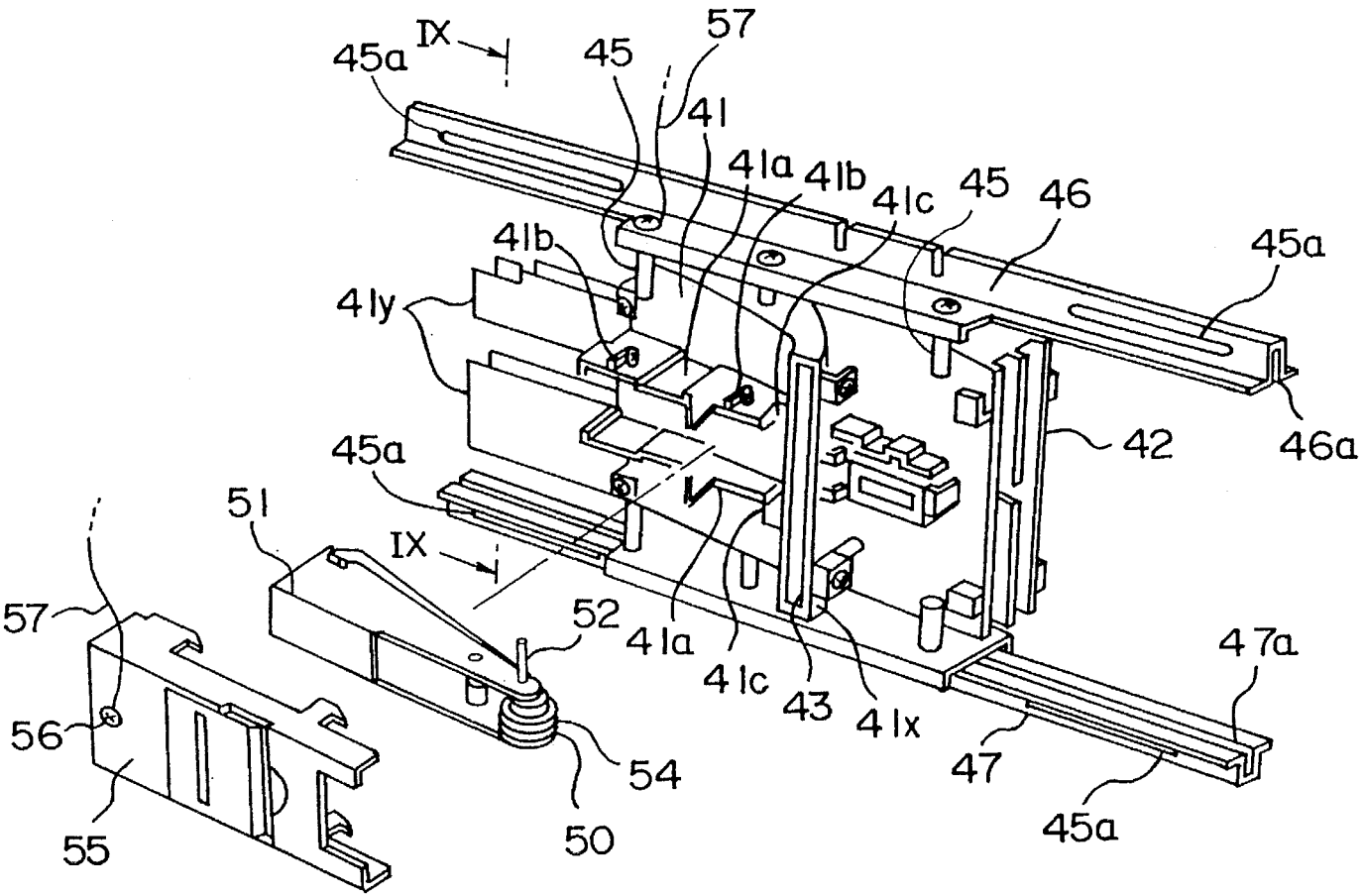
FIG. 13 is a perspective view of the unit at the introducing section in the present invention.

As shown in FIGS. 4 and 13, the introducing unit 40 has a conveying path member 42 which forms a part of the charge collecting line 20 and an introducing path member 41 which introduces the bank note from the bank note discharging slot 14 of the ball lending machine 11 to the charge collecting line 20 formed by the conveying path member 42. The sectional shape of the conveying path member 42 is, as shown in FIGS. 9 and 13, substantially the same as the conveying path member 31 of the conveying unit 30. Thus, when connecting the introducing unit 40 and the conveying unit 30, the conveying path members 42, 31 of each of the units confront each other. The conveying path member 42 is not shown in section in FIG. 9. The introducing path member 41, provided with a bank note receiving slot connected to the bank note discharging slot 14 of the ball lending machine 11, comprises a guide portion 41*x* which curves gradually, as it gets nearer to the charge collecting line, towards where the charge collecting line 20 extends, and a confluence portion 41*y* connected to the guide portion 41*x* and provided within the conveying path member 42 comprising the charge collecting line 20. As shown in FIGS. 4 and 13, a part of the confluence portion 41*y* projects from the conveying path member 42 in the direction of conveyance. The projection of the confluence portion 41*y* fits in the conveying path member 31 of the conveying unit 30 when connecting the introducing unit 40 with the conveying unit 30, as shown in FIGS. 1 and 8.

Both of the conveying path member 42 and the introducing path member 41 of the introducing unit 40 are, as shown in FIG. 13, connected to the above-mentioned upper connecting guide member 46 and the lower connecting guide member 47 by screws 45, 45, . . . . The connecting guide members 46, 47 are extended in the conveyance direction of bank notes, and grooves 46*a*, 47*a*, into which the connecting rails 37, 38 of the conveying unit 30 can fit, are formed thereon. Similar to the connecting rails 37, 38 of the conveying unit 30, elongated holes 45*a*, 45*a* elongated in the conveyance direction of bank notes, which pass through from the row of pachinko machines on one side to the row of pachinko machines on the other side, are formed on the connecting guide members 46, 47.

The introducing unit 40 is connected to the conveying unit 30 in such a manner that the confluence portion 41*y* of the introducing path member 41 fits in the conveying path member 31 of the conveying unit 30, and that the conveying path member 42 and the conveying path member 31 of the conveying unit 30 confront with each other. The connecting rails 37, 38 of the conveying unit 30 fit in the grooves 46*a*, 47*a* of the connecting guide members 46, 47 and are connected to the introducing unit 40 by the screws 45. The screws are inserted into the elongated holes 45*a*, 45*a* of the connecting guide members 46, 47 and into the elongated holes 37*a*, 38*a* of the connecting rails 37, 38 of the conveying unit 30, so that the connecting guide members 46, 47 and the conveying unit 30 are connected by the screws. Since the elongated holes 45*a*, 37*a* . . . , into which the screws are inserted, are elongated toward the conveying direction of the paper strip, the relative position between the conveying unit 30 and the connecting guide members 46, 47 in the conveying direction of the paper strip can be adjusted. Accordingly, the relative position between the introducing unit 40 which is fixed to the connecting guides 46, 47 with the screws 45 and the conveying unit 30 in the conveying direction of the paper strip can be also adjusted.

The introducing unit 40 further includes biasing pulleys 27, 28 provided on both sides of the round belt 25, an introducing roller 50 provided on one side of the introducing path formed with the introducing path member 41, a leaf spring 70 provided on the other side of the introducing path, a roller case 51 which covers the biasing pulley 27 and the introducing roller 50 and a cover 55 which externally covers the roller case 51.

Figure 5:
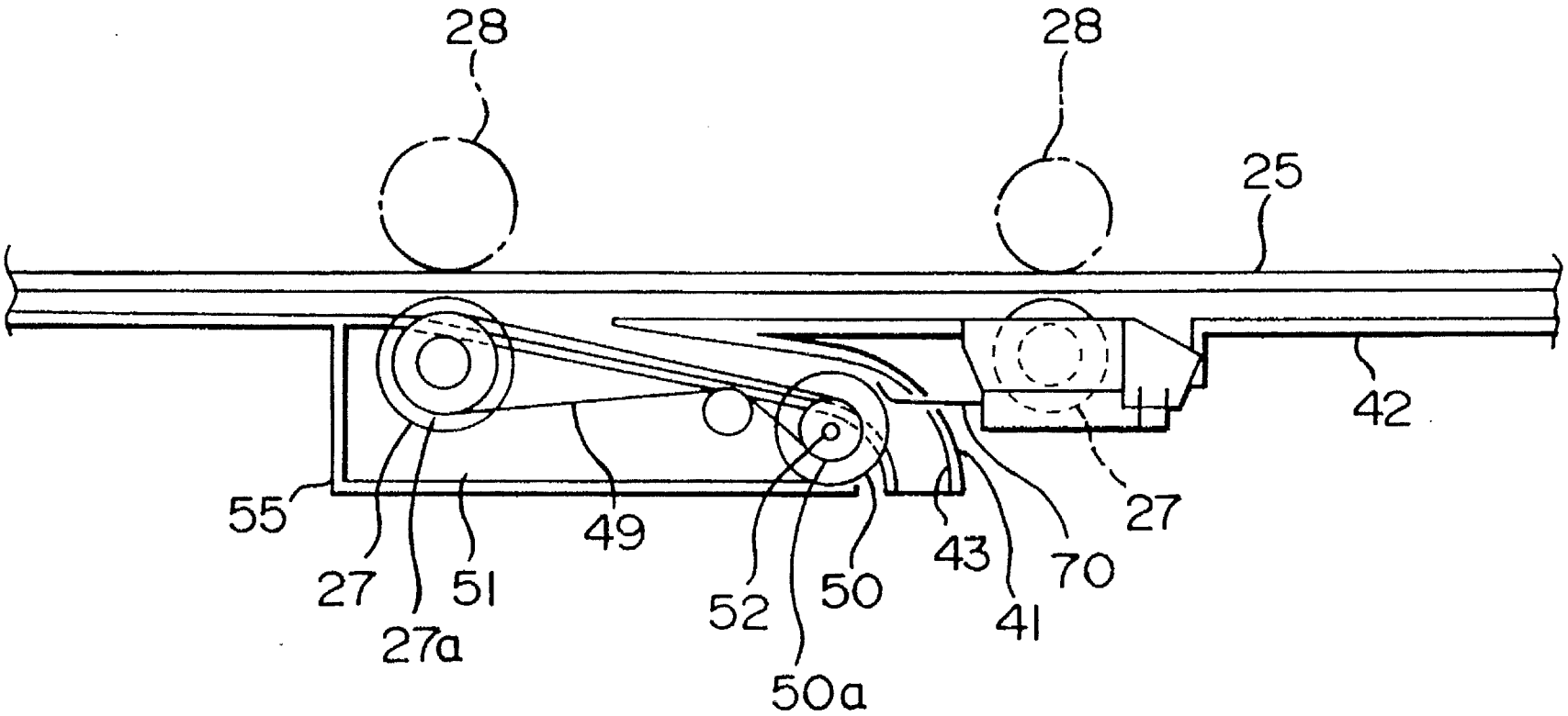
FIG. 5 is a plan figure of the main portion of the unit at the introducing section in the embodiment of the present invention.
Figure 7:
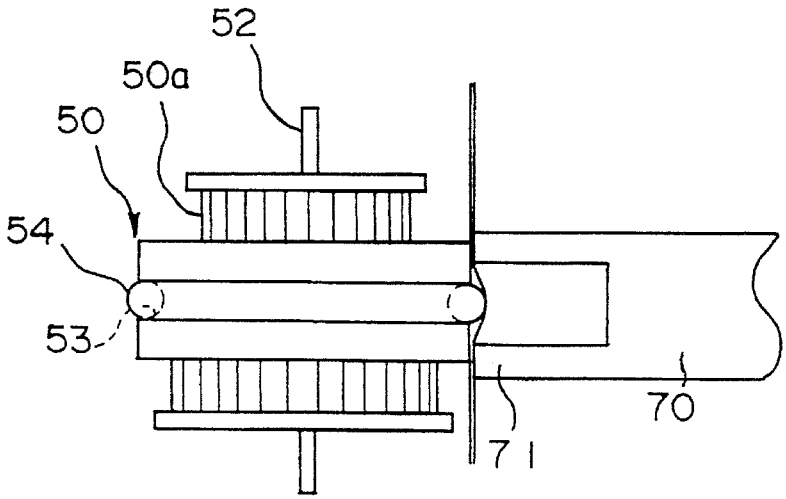
FIG. 7 is a front view of the introducing roller in the embodiment of the present invention.

As shown in FIG. 5, the biasing pulley 27 is supported on a part of the roller case 51 via the rotation shaft. The introducing roller 50 is supported rotatably on the other part of the roller case 51 via the roller shaft 52. Belt pulleys 27*a*, 50*a* are provided on the biasing pulley 27 and the introducing roller 50, respectively, in one body. A timing belt 49 is tensioned between the belt pulley 27*a* of the biasing pulley 27 and the belt pulley 50*a* of the introducing roller 50. As shown in FIG. 7, an outer peripheral groove 53 is formed at the outer periphery of the introducing roller 50, and an O-ring 54 is disposed therein. Thus, the periphery of the introducing roller 50 is swollen at the middle; i.e. the periphery, at the middle, has a substantially larger diameter.

In the introducing path member 41, a frame 41*a* for inserting the roller case 51 is formed. On both side walls of the frame 41*a*, projections 41*b* for fixing the cover which covers the roller case 51 are formed, and a fitting groove 41*c*, into which the introducing roller shaft 52 fits, for limiting the advance of the introducing roller shaft 52 into the introducing path, is formed. The conductive cover 55 is connected to the conductive introducing case 51 by the ground fixing screw 56. One end of the grounding wire 57 is connected to the ground fixing screw 56, and the other end of the grounding wire 57 is connected to the upper connecting guide member 46 by the screw 45.

Figure 6:
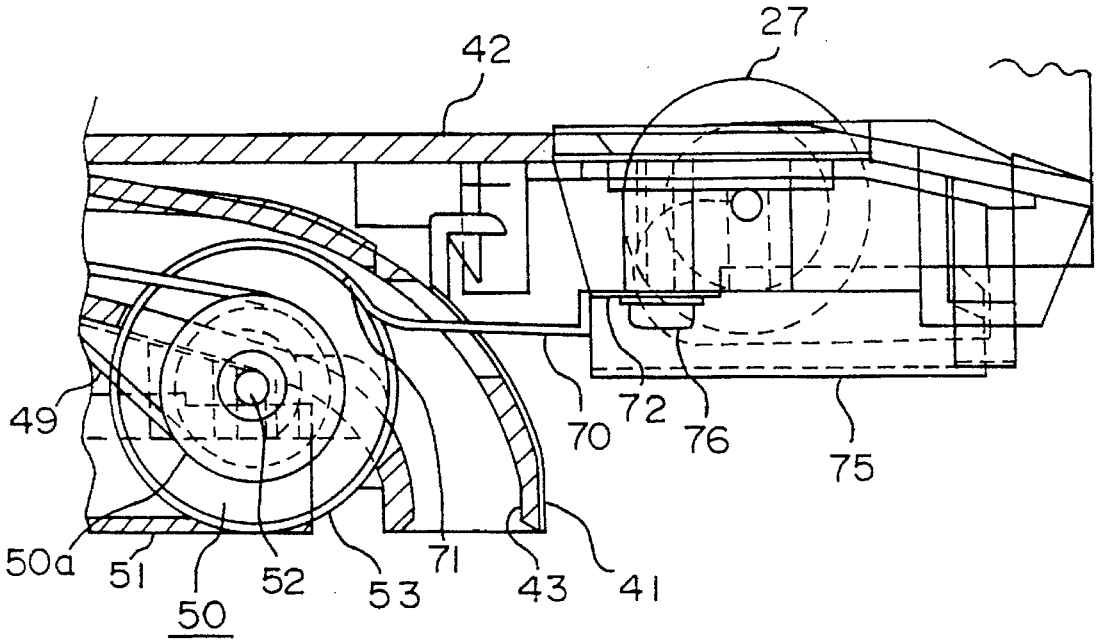
FIG. 6 is a detailed plan figure of a portion in FIG. 5 in the embodiment of the present invention.

On the conveying path member 42 facing the introducing roller 50, having the introducing path of the introducing unit 40 therebetween, as shown in FIG. 6, the leaf spring 70 which sandwiches paper strips or the like with the introducing roller 50 is provided via a conductive holder member 75. A tip portion 71 of the leaf spring, as shown in FIG. 7, is split into two, avoiding the O-ring, so that it faces the peripheral surface of the introducing roller 50. A base portion 72 of the leaf spring 70 is fixed to a holder member 75 with a screw member 76 so that the gap between the tip portion 71 of the leaf spring 70 and the outer peripheral surface of the introducing roller 50 is kept so as to be as wide as the thickness of the bank note.

As shown in FIGS. 1 and 4, the guided flange 77 of the guide portion formed on the conveying path member 42 is formed on the upper and lower edge portions of the holder member 75, respectively. Furthermore, a stopper flange 78 for preventing the holder member 75 from dropping off, which fits in the groove formed on the conveying path member 42, is formed at the rear end portion of the holder member 75.

One end of the grounding wire 79 is connected to the screw member 76 which fixes the holder member 75 to the conveying path member 42, and the other end of the grounding wire 79 is connected to the upper connecting guide member 46 by the screw 45.

The operation will now be explained.

To connect each wire for grounding, each of the grounding wire 57 connected to the ground fixing screw 56 at the roller cover 55 side, the grounding wire 79 connected to the screw member 76 at the holder member 75 side, and the grounding wire not shown connected to the pulley fixing board 36 side may be extended to the nearest part of the upper connecting guide member 46 to be fastened, for example. Accordingly, the ground fixing screw and the screw member 76 do not have to be connected to each other by the grounding wire.

Since the upper connecting guide member 46 is supported on the conductive side wall board 15 of the ball lending machine 11 via the conductive fixing metallic part 81, it is not necessary to purposely connect the grounding wire from the upper connecting guide member 46 side to the side wall board 15 side.

Even when static electricity is potentially to be generated at the introducing roller 50 as a result of friction and the like with the paper strip etc., the static electricity will not be generated thereabouts since the introducing roller 50 is electrically connected to the upper connecting guide member 46 via the shaft 52, the case 51, the cover 55, the ground fixing screw 56, and the grounding wire, all of which are conductive. Moreover, also when static electricity is potentially to be generated at the leaf spring 70 as a result of friction with the paper strip etc., the static electricity will not be generated thereabout since the leaf spring 70 is electrically connected to the upper connecting guide member 46 via the screw 76 and the grounding wire 79.

Similarly, when static electricity is potentially to be generated at the biasing pulleys 27, 28 as a result of friction with the paper strip etc., the static electricity will not be generated thereabout since the biasing pulleys 27, 28 are electrically connected to the upper connecting guide member 46 via the holder member 75, the pulley fixing board 36, and the grounding wire 79.

When a paper strip etc., is discharged from the discharging slots 14 of the ball lending machines 11, 11 . . . to the introducing path of the introducing unit, it is pinched between the introducing roller 50 and the tip portion 71 of the leaf spring 70 within the introducing path. The introducing roller 50 is rotating constantly because it is connected by the timing belt 49 to the biasing pulley 27 which rotates by the contact with the round belt 25. Therefore, the paper strip pinched between the introducing roller 50 and the leaf spring 70 is conveyed from the introducing path to the charge collecting line 20.

If any difficulty in conveyance should occur in the conveying path, the holder member 75, the cover 55 and the roller case 51 are disengaged so as to enable the inside of the introducing unit 40 to be inspected.

In the charge collecting line 20, paper strips and the like are sandwiched between the biasing pulleys 27, 28 and the round belt 25, and are then conveyed in order.

If any difficulty in conveyance should occur in the charge collecting line 20, as shown in FIG. 12, the pulley fixing board 36 is opened.

One of the pair of biasing pulleys 27, 28 moves away from the round belt 25 when the pulley fixing board 36 is opened. This enables inspection of the inside of the conveying unit 30.

Furthermore, although the leaf spring 70 is used as the spring member in the above mentioned embodiment, a linear spring member, for example, may be used instead.

What is claimed is:

1. A paper strip conveying apparatus which introduces, to an object conveying path, a paper strip discharged from a paper strip discharging machine provided along said object conveying path comprising:

a path forming member which forms said object conveying path along which said paper strip passes;

an endless belt provided along said object conveying path so that its periphery comes in contact with one of the two faces of said paper strip conveyed along said object conveying path;

a belt driving mechanism which rotates said endless belt;

a plurality of pulleys provided along said object conveying path so that the peripheries of the pulleys come in contact with the other face of said paper strip;

rotating axes means of said pulleys formed of conductive material;

supporting metallic parts which support said rotating axes means formed of conductive material;

an introducing path member which forms an introducing path for introducing a paper strip discharged from said paper strip discharging machine;

an introducing roller provided along said object conveying path so that its periphery comes in contact with one of the two faces of said paper strip which comes into said introducing path from said paper strip discharging machine;

a rotating axis means of said roller formed of conductive material;

roller supporting metallic parts which support said roller rotating axis means formed of conductive material;

a roller driving mechanism which rotates said introducing roller;

a conductive elastic member provided to face said introducing roller and having an outer peripheral surface that comes in contact with the other face of said paper strip;

elastic member supporting metallic parts which support said conductive elastic member;

a main body frame formed of conductive material, electrically connected to ground, and which supports said path forming member and said introducing path member by being formed along said object conveying path; and a conductor which electrically connects said main body frame to each said rotating axes means supporting metallic part, each said roller supporting metallic part, and each said elastic member supporting metallic part, respectively.

2. A paper strip conveying apparatus as defined in claim 1, wherein one of said introducing path member and said path forming member, is relatively fixed to said main body frame while the other member is relatively fixed to be movable in the direction in which said object conveying path extends.

3. A paper strip conveying apparatus as defined in claim 2, wherein said roller driving mechanism includes:

a driver side pulley provided at a pulley rotating axis means to rotate with the rotation of the associated pulley;

a driven side pulley provided to said roller and with which said roller rotates; and a roller driving belt placed on said driver side pulley and said driven side pulley.

4. A paper strip conveying apparatus as defined in claim 1, wherein said roller driving mechanism includes:

a driver side pulley provided at a pulley rotating axis means to rotate with the rotation of the associated pulley;

a driven side pulley provided to said roller and with which said roller rotates; and a roller driving belt placed on said driver side pulley and said driven side pulley.

* * * * *